US006588127B1

(12) United States Patent
Brittian, III

(10) Patent No.: US 6,588,127 B1
(45) Date of Patent: Jul. 8, 2003

(54) SKID LOADER ATTACHMENT

(76) Inventor: Russell Brittian, III, 307 Hillcrest Ave., Baltimore, MD (US) 21225

( * ) Notice: Subject to any disclaimer, the term of this patent is extended or adjusted under 35 U.S.C. 154(b) by 0 days.

(21) Appl. No.: 10/171,940

(22) Filed: Jun. 14, 2002

(51) Int. Cl.[7] ..... E02F 3/96
(52) U.S. Cl. ..... 37/403; 414/685
(58) Field of Search ..... 37/403, 404, 405, 37/406, 407, 408, 409, 410, 903; 172/817; 414/724, 912, 685, 722

(56) References Cited

U.S. PATENT DOCUMENTS

| | | | | | |
|---|---|---|---|---|---|
| 2,590,352 | A | * | 3/1952 | Sanner et al. | 37/347 |
| 2,896,343 | A | * | 7/1959 | Raby | 37/407 |
| 3,305,951 | A | * | 2/1967 | Nunn | 172/700 |
| 3,381,937 | A | | 5/1968 | Zillman | |
| 3,478,449 | A | * | 11/1969 | Baker | 172/719 |
| 3,667,633 | A | | 6/1972 | Cappella | |
| 3,938,680 | A | * | 2/1976 | Grimes | 37/409 |
| 4,068,771 | A | * | 1/1978 | Zimmerman | 37/403 |
| 4,242,035 | A | | 12/1980 | Hornstein | |
| 4,550,512 | A | | 11/1985 | Felstef | |
| 4,903,418 | A | * | 2/1990 | Loudon | 111/101 |
| 5,020,249 | A | * | 6/1991 | Matthews | 37/444 |
| D320,397 | S | | 10/1991 | Gomez | |
| 5,443,126 | A | * | 8/1995 | Skj veland | 172/265 |
| 5,628,130 | A | * | 5/1997 | Desrochers | 172/701.1 |
| 5,692,875 | A | * | 12/1997 | Boman | 37/903 |
| 5,848,871 | A | * | 12/1998 | Thiessen | 414/607 |
| 5,901,479 | A | * | 5/1999 | Langdon | 37/379 |
| 5,953,839 | A | * | 9/1999 | Meeks | 172/247 |
| 6,058,447 | A | * | 5/2000 | Holst et al. | 710/105 |
| 6,098,320 | A | * | 8/2000 | Wass | 37/406 |
| 6,216,367 | B1 | * | 4/2001 | Tubbs | 209/474 |
| 6,243,975 | B1 | * | 6/2001 | Gall | 37/407 |
| 6,244,418 | B1 | * | 6/2001 | Desrochers | 198/316.1 |
| 6,446,368 | B1 | * | 9/2002 | Watts | 37/450 |

* cited by examiner

*Primary Examiner*—Thomas B. Will
*Assistant Examiner*—Kristine Florio

(57) ABSTRACT

A skid loader attachment includes a coupling assembly designed for mounting the device onto a skid loader. The coupling assembly further includes a plate portion that has a plurality of apertures. Each one of the apertures is alignable with an associated skid loader aperture. Each of a plurality of fastening members is insertable into an associated pairing of the aperture and the skid loader aperture. The plurality of fasteners secures the plate portion to the skid loader mounting portion. A tongue portion is operationally coupled to the plate portion. The tongue portion has a top surface that defines a plane. The tongue portion is positioned such that the plane has an angular relationship with a plane defined by a forward surface of the plate portion. The tongue portion is substantially elongate. The tongue portion facilitates movement of material around obstacles such as conveyor belts and rocks.

9 Claims, 3 Drawing Sheets

SKID LOADER ATTACHMENT

BACKGROUND OF THE INVENTION

1. Field of the Invention

The present invention relates to skid loader attachment devices and more particularly pertains to a new skid loader attachment for providing a new type of attachment of skid loaders and related types of machines.

2. Description of the Prior Art

The use of skid loader attachment devices is known in the prior art. U.S. Pat. No. 4,903,418 describes a hydraulic loader attachment for removing trees, bushes and other plants for transplantation and other purposes consisting of an elongated, concave scoop mounted on a rigid frame. Another type of skid loader attachment devices is U.S. Pat. No. 4,242,035 describing an apparatus for converting a loader bucket to a pallet loader. U.S. Pat. No. 3,381,937 describes a wedge for use with a loader. U.S. Pat. No. 3,667,633 describes a fork lift attachment having a pair of lift elements in laterally spaced relation between pivotal segments of a bucket mounted on an earth handling apparatus. U.S. Pat. No. 4,550,512 describes an excavator bucket with detachable implements. U.S. Pat. No. Des. 320,397 describes an ornamental design for a bidirectional moldboard plow.

While these devices fulfill their respective, particular objectives and requirements, the need remains for a device that allows a user to get into, under, and over hard to reach places.

SUMMARY OF THE INVENTION

The present invention meets the needs presented above by including an elongate tongue portion that is operationally coupled to the plate portion. The tongue portion facilitates movement of material around obstacles such as conveyor belts and rocks.

Another object of the present invention is to provide a new skid loader attachment that is easy to operate and would be compatible with most common makes and models of hydraulic loaders.

Still another object of the present invention is to provide a new skid loader attachment that could enable bulk materials located under conveyor belts, hoppers, and other machinery and structures to be comparatively easily extracted and collated in a large accessible pile.

To this end, the present invention generally comprises a coupling assembly designed for mounting the device onto a skid loader. The coupling assembly further includes a plate portion that has a plurality of apertures. The plate portion is designed for abutting a mounting portion of a skid loader. Each one of the apertures is alignable with an associated skid loader aperture. Each of a plurality of fastening members is insertable into an associated pairing of the aperture and the skid loader aperture. The plurality of fasteners secures the plate portion to the skid loader mounting portion. A tongue portion is operationally coupled to the plate portion. The tongue portion has a top surface that defines a plane. The tongue portion is positioned such that the plane has an angular relationship with a plane defined by a forward surface of the plate portion. The tongue portion is substantially elongate. The tongue portion facilitates movement of material around obstacles such as conveyor belts and rocks.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
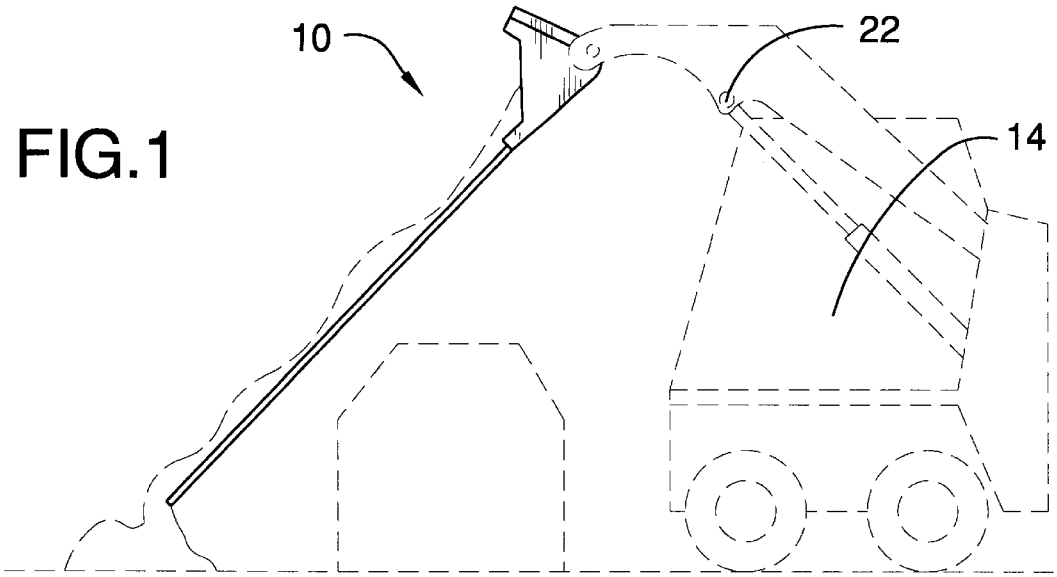
FIG. 1 is an in-use view of a new skid loader attachment according to the present invention.
Figure 2:
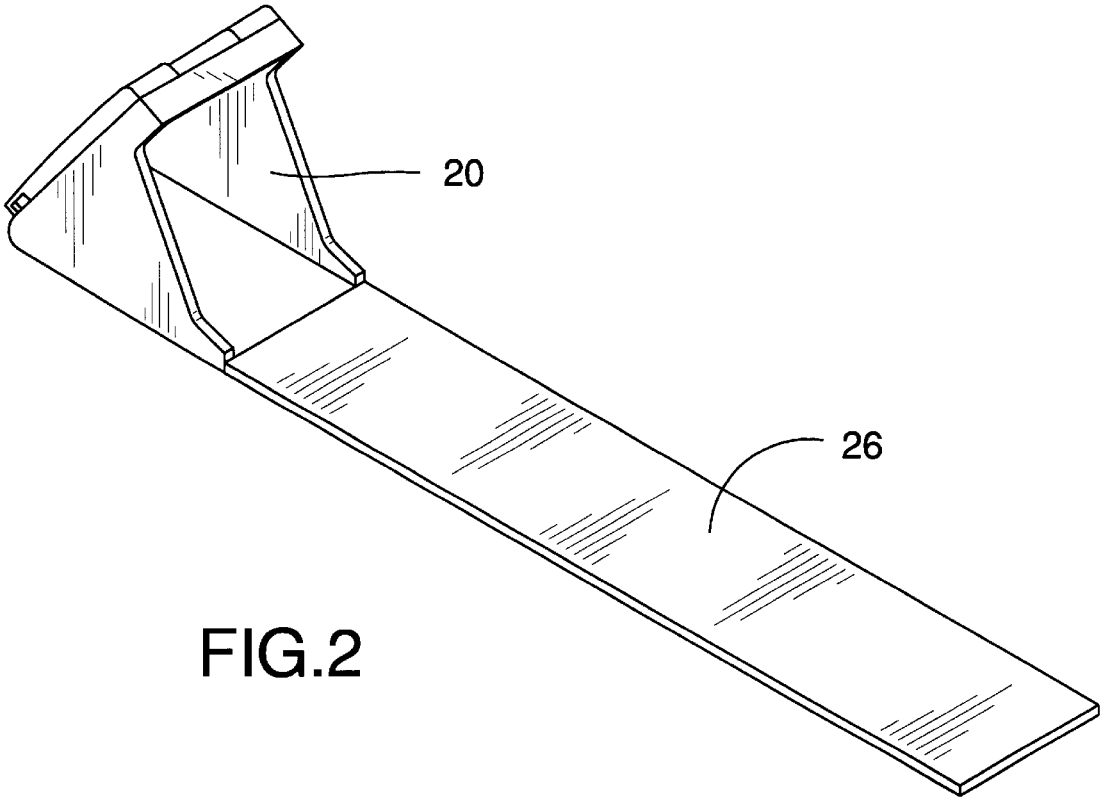
FIG. 2 is a perspective view of the present invention.
Figure 3:
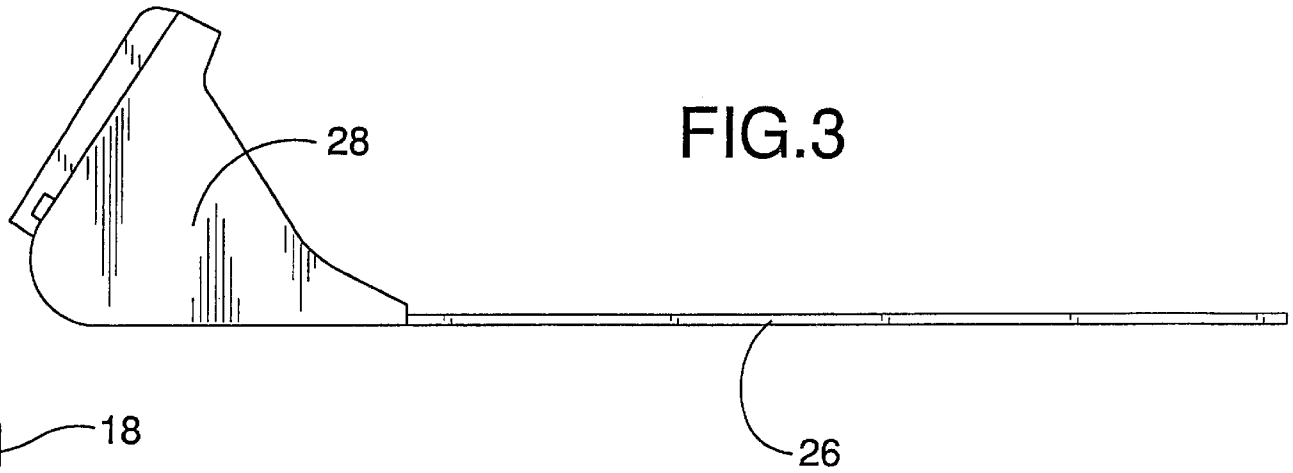
FIG. 3 is a side view of the present invention.
Figure 4:
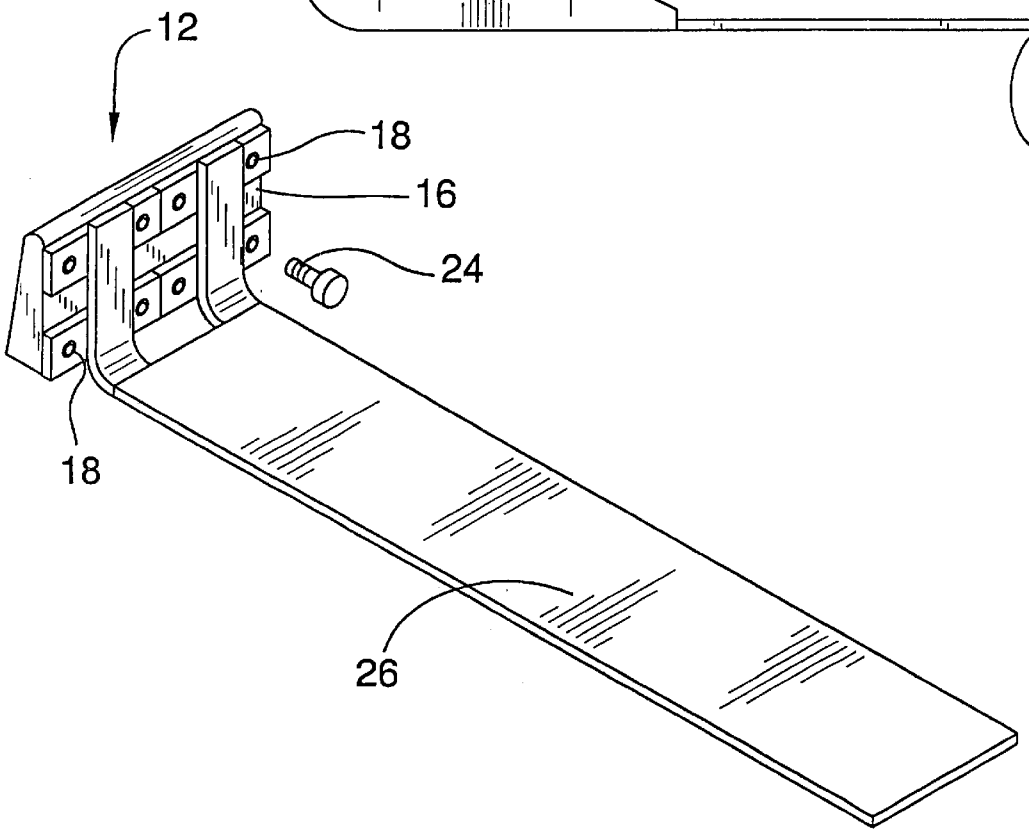
FIG. 4 is a perspective view of the present invention.
Figure 5:
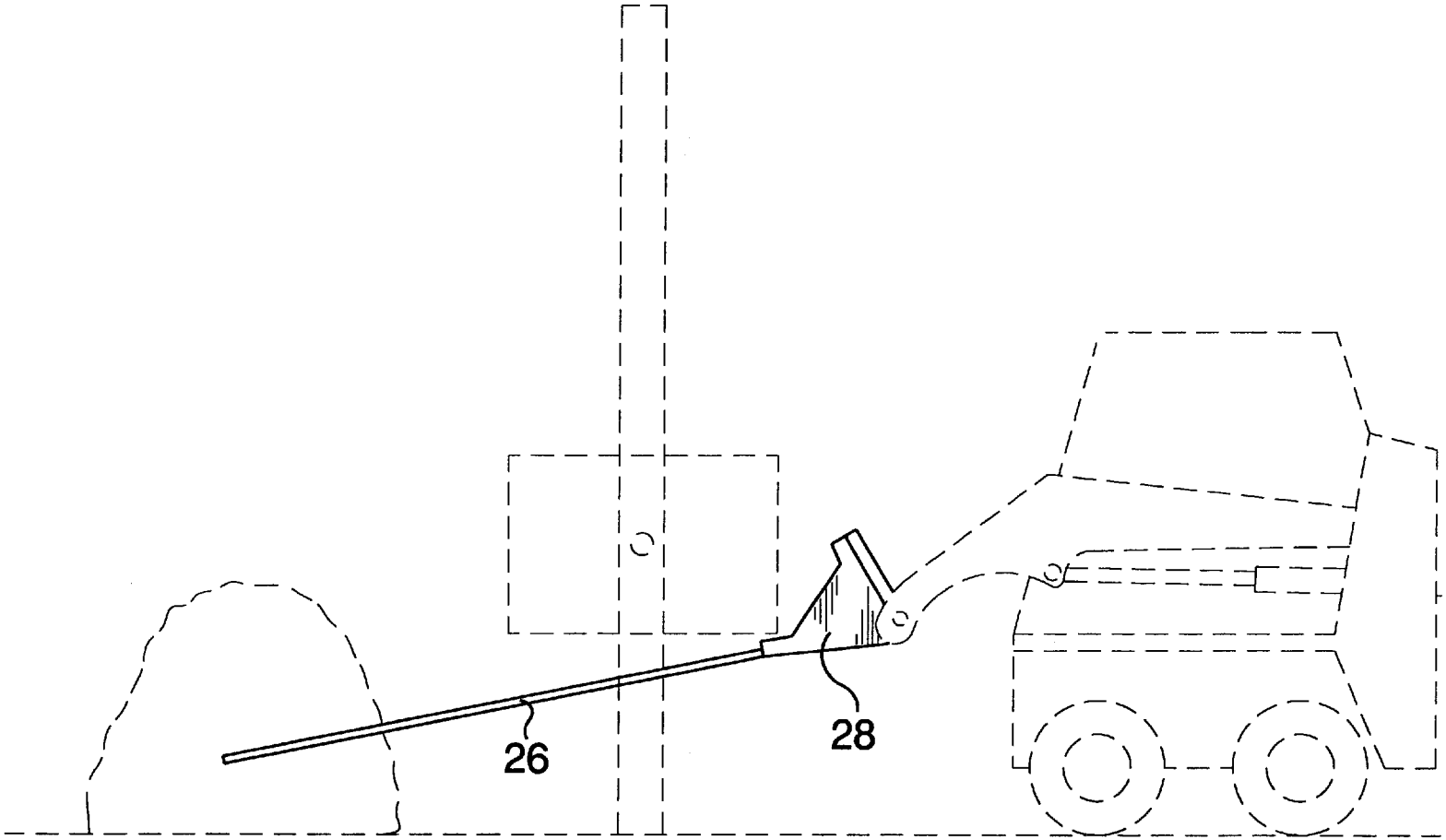
FIG. 5 is a side view of the present invention in use.

With reference now to the drawings, and in particular to FIGS. 1 through 5 thereof, a new skid loader attachment embodying the principles and concepts of the present invention and generally designated by the reference numeral 10 will be described.

As best illustrated in FIGS. 1 through 5, the skid loader attachment 10 generally comprises a coupling assembly 12 designed for mounting the device onto a skid loader 14. The coupling assembly 12 further includes a plate portion 16 that has a plurality of apertures 18. The plate portion 16 is designed for abutting a mounting portion 20 of a skid loader 14. Each one of the apertures 18 is alignable with an associated skid loader aperture 22. Each of a plurality of fastening members 24 is insertable into an associated pairing of the aperture 18 and the skid loader aperture 22. The plurality of fastening members 18 secures the plate portion 16 to the skid loader mounting portion 20. A tongue portion 26 is operationally coupled to the plate portion 16. The tongue portion 26 has a top surface that defines a plane. The tongue portion 26 is positioned such that the plane has an angular relationship with a plane defined by a forward surface of the plate portion 16. The tongue portion 26 is substantially elongate. The tongue portion 26 facilitates movement of material around obstacles such as conveyor belts and rocks.

The tongue portion 26 includes steel. The tongue portion 26 is substantially rectangular. The tongue portion 26 has a longitudinal axis and a lateral axis. The longitudinal axis is substantially greater than the lateral axis. The tongue portion 26 has a width of approximately 24 inches. The tongue portion 26 has a length between 6 and 10 feet inclusive.

The bucket portion 28 is operationally coupled to the coupling assembly 12. The bucket portion 28 is for containing material during transit.

In an embodiment the present invention would have various blade configurations having varying lengths and widths.

In use, a user would attach the present invention to a skid loader in place of a bucket to get into under and over small hard to reach places.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hydraulic loader attachment device for use around obstacles, comprising:

a coupling assembly adapted for mounting said device onto a skid loader;

said coupling assembly further comprising:

a plate portion having a plurality of apertures, said plate portion being adapted for abutting a mounting portion of a skid loader, each one of said apertures being alignable with an associated skid loader aperture;

a plurality of fastening members, each one of said fastening members being insertable into an associated pairing of said aperture and the skid loader aperture, said plurality of fasteners securing said plate portion to the skid loader mounting portion;

a tongue portion operationally coupled to said plate portion, said tongue portion having a top surface defining a plane, said tongue portion being positioned such that said plane has an angular relationship with a plane defined by a forward surface of said plate portion; said tongue portion being substantially elongate, said tongue portion facilitating movement of material around obstacles such as conveyor belts and rocks; and a bucket portion being operationally coupled to said coupling assembly, said bucket portion being for containing material during transit, said bucket portion having a bottom surface defining a plane, said plane being parallel with said plane defined by said tongue portion.

2. The device of claim 1, wherein said tongue portion comprises steel.

3. The device of claim 1, wherein said tongue portion being substantially rectangular, said tongue portion having a longitudinal axis and a lateral axis, said longitudinal axis being substantially greater than said lateral axis.

4. The device of claim 3, wherein said tongue portion having a width in the range between 12 and 36 inches inclusive.

5. The device of claim 3, wherein said tongue portion having a width in the range between 18 and 30 inches inclusive.

6. The device of claim 3, wherein said tongue portion having a width of approximately 24 inches.

7. The device of claim 3, wherein said tongue portion having a length between 4 and 12 feet inclusive.

8. The device of claim 3, wherein said tongue portion having a length between 6 and 10 feet inclusive.

9. A hydraulic loader attachment device for use around obstacles, comprising:

an coupling assembly adapted for mounting said device onto a skid loader;

said coupling assembly further comprising:

a plate portion having a plurality of apertures, said plate portion being adapted for abutting a mounting portion of a skid loader, each one of said apertures being alignable with an associated skid loader aperture;

a plurality of fastening members, each one of said fastening members being insertable into an associated pairing of said aperture and the skid loader aperture, said plurality of fasteners securing said plate portion to the skid loader mounting portion;

a tongue portion operationally coupled to said plate portion, said tongue portion having a top surface defining a plane, said tongue portion being positioned such that said plane has an angular relationship with a plane defined by a forward surface of said plate portion; said tongue portion being substantially elongate, said tongue portion facilitating movement of material around obstacles such as conveyor belts and rocks; and wherein said tongue portion comprises steel;

wherein said tongue portion being substantially rectangular, said tongue portion having a longitudinal axis and a lateral axis, said longitudinal axis being substantially greater than said lateral axis;

wherein said tongue portion having a width of approximately 24 inches; wherein said tongue portion having a length between 6 and 10 feet inclusive; and a bucket portion being operationally coupled to said coupling assembly, said bucket portion being for containing material during transit, said bucket portion having a bottom surface defining a plane, said plane being parallel with said plane defined by said tongue portion.

* * * * *